US008672014B2

(12) United States Patent
Coenraets

(10) Patent No.: US 8,672,014 B2
(45) Date of Patent: Mar. 18, 2014

(54) DEVICE WITH A FLEXIBLE CURTAIN HAVING A SERRATED BELT WITH TEETH THAT INTERLOCK WHEN THE CURTAIN IS ROLLED UP

(75) Inventor: Benoit Coenraets, Brussels (BE)

(73) Assignee: Dynaco Europe NV, Moorsel-Aalst (BE)

( * ) Notice: Subject to any disclaimer, the term of this patent is extended or adjusted under 35 U.S.C. 154(b) by 0 days.

(21) Appl. No.: 12/526,226

(22) PCT Filed: Jan. 31, 2008

(86) PCT No.: PCT/EP2008/051205

§ 371 (c)(1),
(2), (4) Date: Aug. 6, 2009

(87) PCT Pub. No.: WO2008/101781

PCT Pub. Date: Aug. 28, 2008

(65) Prior Publication Data

US 2010/0000692 A1 Jan. 7, 2010

(30) Foreign Application Priority Data

Feb. 7, 2007 (EP) ..... 07101860

(51) Int. Cl.
*A47G 5/02* (2006.01)

(52) U.S. Cl.
USPC ..... 160/273.1; 160/271; 160/270; 160/268.1

(58) Field of Classification Search
USPC ..... 160/268.1, 264, 270, 271, 273.1
See application file for complete search history.

(56) References Cited

U.S. PATENT DOCUMENTS

| | | | | | |
|---|---|---|---|---|---|
| 2,349,226 | A * | 5/1944 | Thomas | 160/273.1 |
| 4,586,552 | A * | 5/1986 | Labelle | 160/133 |
| 5,058,651 | A * | 10/1991 | Ashley et al. | 160/271 |
| 5,353,858 | A * | 10/1994 | Hartmann | 160/264 |
| 5,445,209 | A * | 8/1995 | Lichy | 160/273.1 |
| 5,482,104 | A * | 1/1996 | Lichy | 160/273.1 |
| 5,586,592 | A * | 12/1996 | McGregor | 160/133 |
| 6,119,758 | A * | 9/2000 | Coenraets | 160/273.1 |
| 7,275,581 | B2 * | 10/2007 | Coenraets | 160/273.1 |
| 7,841,377 | B2 * | 11/2010 | Coenraets | 160/268.1 |

FOREIGN PATENT DOCUMENTS

| | | |
|---|---|---|
| DE | 19636176 A1 | 3/1998 |
| WO | 03048497 A1 | 6/2003 |

* cited by examiner

*Primary Examiner* — Katherine Mitchell
*Assistant Examiner* — Marcus Menezes
(74) *Attorney, Agent, or Firm* — Browdy and Neimark, PLLC

(57) ABSTRACT

The invention concerns a device with a curtain (2) that can be rolled up and unrolled between a shut position and an open position comprising, near the lateral edges (3) on each face, a serrated belt (1,6) extending parallel to said lateral edges (3), whereby each of the belts (1,6) has successive teeth (5,8). The lateral face of the teeth, extending in the longitudinal direction of the corresponding lateral edge (3) of at least one of the belts (1,6) provided on a face of the curtain (2) rests on a supporting element when the curtain (2) is rolled up. This supporting element is provided on the other face of the curtain (2).

14 Claims, 4 Drawing Sheets

DEVICE WITH A FLEXIBLE CURTAIN HAVING A SERRATED BELT WITH TEETH THAT INTERLOCK WHEN THE CURTAIN IS ROLLED UP

The present invention concerns a device with a curtain that can be rolled up and unrolled between a shut position and an open position so as to shut or open a bay or another opening, whereby the curtain has two serrated belts near its lateral edges comprising a succession of teeth, whereby both these belts are situated opposite one another so that, when the curtain is rolled up, the two belts can mesh.

Said device can be designed to shut a door or window opening, the loading space of a vehicle, such as a lorry or a vessel, to cover a swimming pool, etc.

When the curtain of known devices of this type is rolled up or unrolled into its open position or shut position, the lateral edges may possibly not be correctly rolled up or unrolled, but slide sideways, which generally results in a disengagement of the belts.

The main aim of the present invention is to avoid this problem in a very simple and very efficient manner.

To this aim, a lateral face of the teeth extending in the longitudinal direction of the lateral edge corresponding to at least one of the belts provided on a face of the curtain will rest on a supporting element when the curtain is rolled up, whereby this supporting element is provided on the other face of the curtain.

Preferably, the curtain has a standing edge near each of its lateral edges, parallel to the latter.

Advantageously, the standing edge is provided on the belt situated on the side of the interior face of the curtain in its rolled-up position.

According to a special embodiment of the invention, the standing edge extends substantially up to the upper face of the heads of the serrated belt's teeth.

According to another embodiment of the invention, the standing edge is provided on the side of the teeth opposite the one directed towards the lateral edge of the curtain.

Other details and particularities of the invention will become clear from the description, given hereafter by way of example only without being limitative in any way, of some special embodiments of the invention with reference to the accompanying drawings.

In the different drawings, the same figures of reference refer to analogous or identical elements.

In a general manner, the present invention concerns a device with a curtain that can be rolled up between a shut position and an open position, in particular to shut or open a bay or any other opening whatsoever. Near its lateral edges, the curtain has two serrated belts comprising a succession of teeth extending in the longitudinal direction. These two belts are situated on either side of the curtain, opposite one another, so that they can mesh when the curtain is being rolled up.

The present device is characterised in that the teeth of at least one of the serrated belts, provided on a face of the curtain, will rest on a supporting element provided on the other face of the curtain near the corresponding lateral edge when the curtain is rolled up.

Preferably, the curtain has a supporting element near each of its lateral edges, formed of a standing edge extending parallel to these lateral edges. In particular, a standing edge is concerned provided on the belt situated on the side of the inner face of the curtain. By the inner face of the curtain is meant the face of the curtain which is directed towards the axis of curvature of the curtain when the latter is rolled up.

Figure 1:
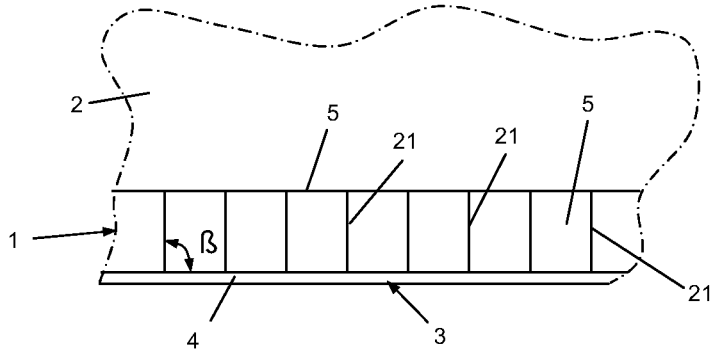
FIG. 1 is a schematic top view of a first particular embodiment of the invention.

FIG. 1 schematically shows a top view of a part of a serrated belt 1 fixed to one of the faces of a curtain 2 near a lateral edge 3 of the latter. This belt 1 comprises a succession of teeth 5 extending at right angles to its longitudinal axis, i.e. the bases of successive front faces 21 of the teeth 5 in the longitudinal direction of the belt 1 form an angle $\beta$ of 90° with said axis.

The side of the belt 1 which is directed towards the lateral edge 3 of the curtain 2 is situated on the inner face of the latter, when it is rolled up, and has a standing edge 4 extending along said edge 3 and up to the upper face of the teeth 5. The lateral face of the standing edge 4 which is adjacent to the teeth 5 is fixed to these teeth.

The presence of the standing edge 4 makes it possible to prevent a belt from sliding transversally in relation to the belt with which it meshes. Moreover, the presence of a standing edge along each of the lateral edges 3 on one of the faces of the curtain 2 makes it possible to stretch the latter between the corresponding belts, which are fixed to the opposite lateral edges 3 when the curtain 2 is rolled up.

Figure 2:
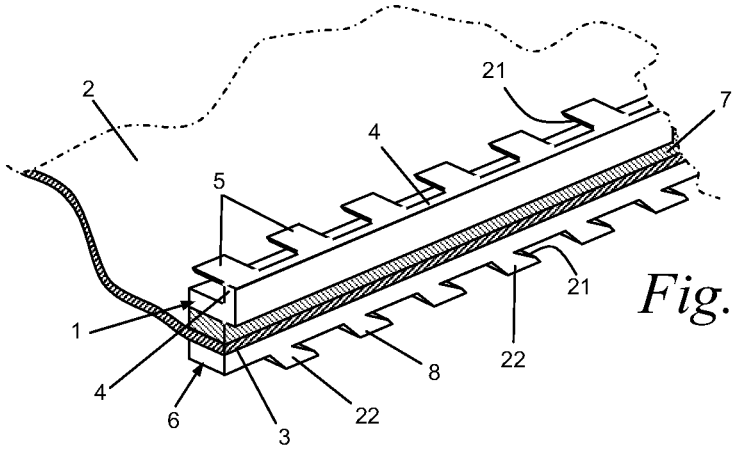
FIG. 2 is a view in perspective of the same embodiment.

FIG. 2 shows an embodiment of the invention in greater detail, comprising on either side of the curtain 2, near the lateral edge 3, two serrated belts 1 and 6 whereby the belt 1 has a standing edge 4. The section of the teeth of the serrated belts 1 and 6 in the longitudinal direction of the belts and in a substantially transversal plane in relation to the plane of the curtain 2, has the shape of a parallelogram.

As already mentioned above in relation to FIG. 1 and as clearly indicated in FIG. 2, the teeth 5 of the belt 1 situated on the inner side of the curtain 2 extend up to the same level as the standing edge 4, such that the top surface of the teeth 5 extends in the same plane as the top surface of the standing edge 4. Moreover, these teeth 5, and thus the belt 1, form a whole with said standing edge 4.

Moreover, a flexible strip 7 is advantageously provided between the curtain 2 and the belt 1. This strip 7 is substantially incompressible lengthwise, such that it is possible to exert a pushing force on the lateral edges 3 of the curtain 2 in their longitudinal direction so as to move the latter from its open position into its shut position.

When the belts 1 and 6 as a whole are sufficiently incompressible so as to make it possible to exert a pushing force on them in their longitudinal direction, it is clear that it will not be necessary to provide the above-mentioned flexible strip 7. Suitable belts are for example made of polyurethane.

Figure 3:
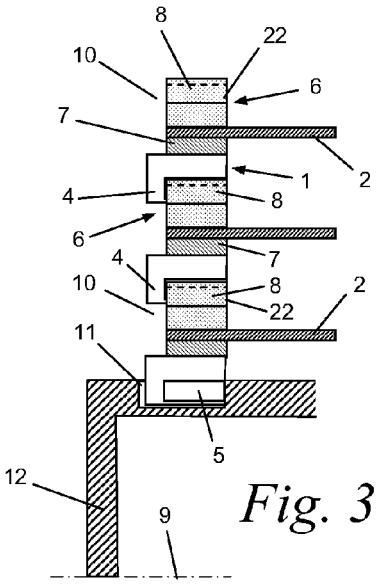
FIG. 3 is a cross section according to a plane going through the axis of the rolling drum of a part of this embodiment in a rolled-up position of the curtain.
Figure 4:
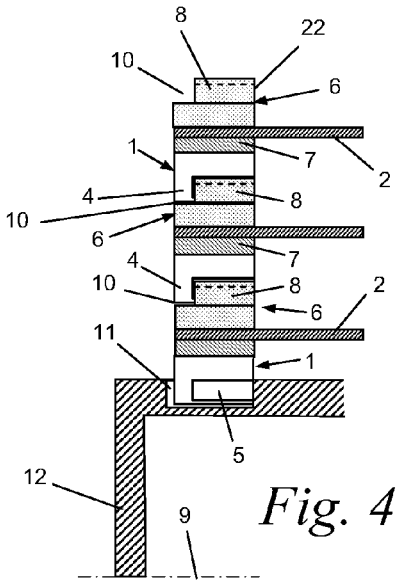
FIG. 4 shows a section analogous to that in FIG. 3 of a variant of the embodiment represented in FIGS. 1 to 3.

As shown in FIGS. 3 and 4, the curtain has, on the face opposite the one in which the serrated belt 1 with the standing edge 4 is provided, a corresponding recess 10 in which said standing edge 4 can engage when the curtain 2 is being rolled up.

These figures are transversal sections of a part of a curtain 2 which has been rolled up on a drum 12. It is a section according to a plane going through the axis 9 of the drum 12.

We can see the way in which the teeth 5 and 8 of the two belts 1 and 6 mesh when the curtain 2 is being rolled up. The standing edge 4 extends laterally in relation to the teeth 5 of the belt 1.

In FIG. 3, the recess 10 is obtained by making the belt 1 pass beyond the lateral edge 3 of the curtain over a distance which corresponds to the width of the standing edge 4. Thus, when the curtain 2 is being rolled up, said standing edge 4 engages in said recess 10 while the belts 1 and 6 mesh. In this way, the standing edge 4 rests on the teeth 8 of the belt 6.

As such a belt 1 with a standing edge 4 is provided on both lateral edges of the curtain 2, a winding which is formed while the curtain 2 is being rolled up will be laterally fixed in relation to the previous winding.

The embodiment represented in FIG. 4 differs from the one described in FIGS. 1 to 3 in that the recess 10 is provided laterally in the teeth 8 of the belt 6 and has the same width as the standing edge 4.

The standing edge 4 rests laterally on the teeth 8 of the belt 6, which prevents any lateral sliding of the belts 1 and 6 in relation to one another.

The curtain 2 is rolled up on a drum 12 in which is provided a groove 11 extending over the perimeter of the drum 12. While the curtain 2 is being rolled up so as to form a first winding, the teeth 5 of the belt 1 with the standing edge 4 engages in said groove 11.

Figure 5:
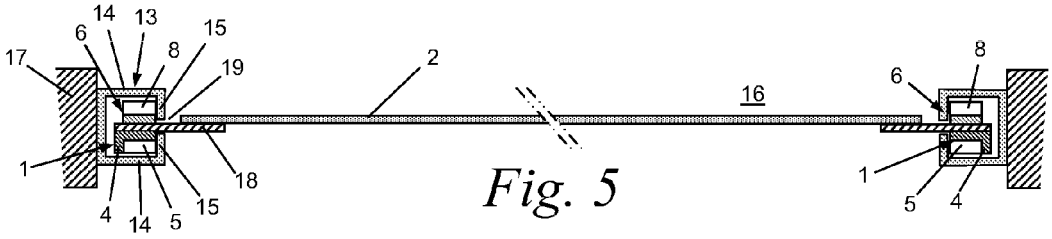
FIG. 5 is a cross section of a curtain whose lateral edges are guided by sliding rails mounted in a bay according to a particularly interesting embodiment of the invention.

FIG. 5 shows a cross section of a curtain 2 whose lateral edges are guided in sliding rails 13 mounted on either side of a bay 16 provided in a wall 17. These sliding rails 13 comprise a section with a U-shaped cross section in which the far ends 15 of the wings 14 are folded towards each other, such that said lateral edges are kept in place, and so as to allow the passage of the curtain 2 through a slit 19 provided between said far ends 15.

The lateral edges of the curtain 2 comprise a flexible strip 18 on which are provided toothed belts 1 and 6 as already described above. This flexible strip 18 is fixed over its entire length to the body of the curtain 2.

These belts 1 and 6 are kept in place in the corresponding sliding rail 13, such that the lateral faces 22 of the teeth 8 of the belt 6 and of the teeth 5 of the belt 1 rest on said far ends 15. The latter extend parallel in relation to said lateral faces 22 on either side of the slit 13 through which the curtain 2 extends.

In a variant of the embodiment represented in FIG. 5, the standing edge 4 is provided on the side of the belt 6' opposite the one which is directed towards the lateral edge of the curtain 2.

Figure 6:
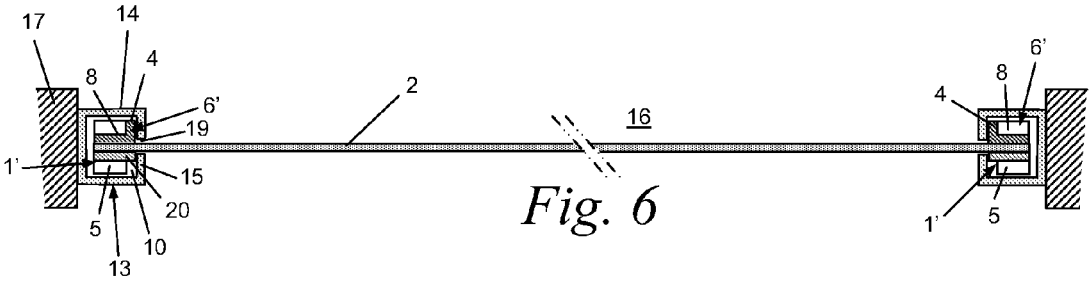
FIG. 6 is a cross section of a curtain whose lateral edges are guided by sliding rails mounted in a bay according to another interesting embodiment of the invention.
Figure 7:
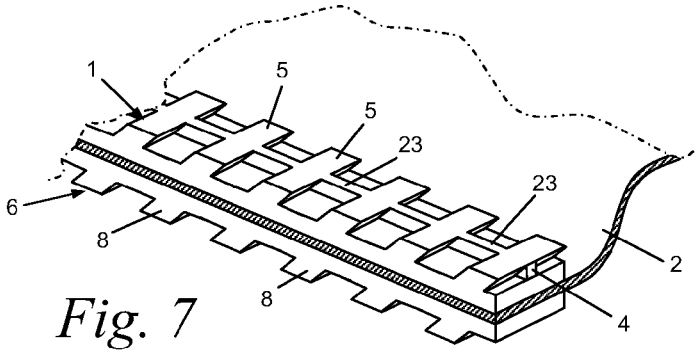
FIG. 7 shows a view in perspective of a part a curtain's face according to yet another embodiment of the invention.
Figure 8:
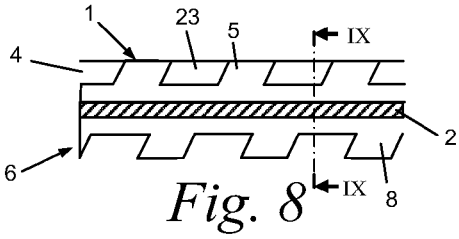
FIG. 8 is a side view of a lateral edge of the curtain from FIG. 7.
Figure 9:
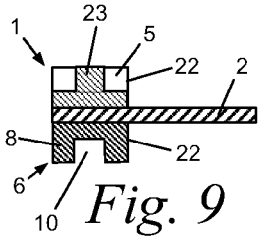
FIG. 9 is a cross section of said edge according to line IX-IX in FIG. 8.
Figure 10:
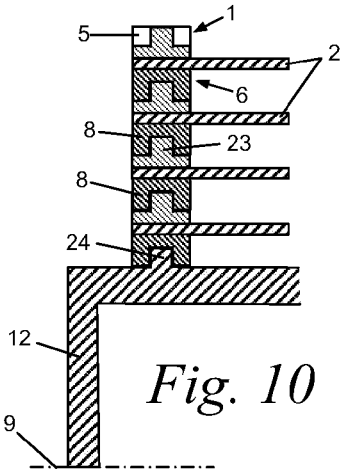
FIG. 10 is a cross section according to a plane going through the axis of the rolling drum of a part of the curtain according to the embodiment represented in FIG. 7 in a rolled-up position of the curtain.
Figure 11:
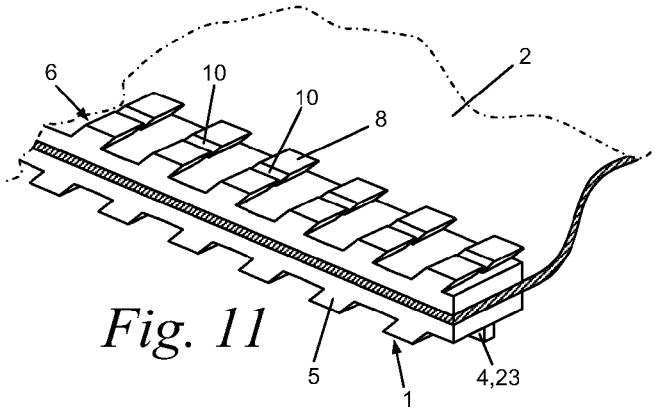
FIG. 11 is a view in perspective of a part of the other face of the curtain from FIG. 7.

In this embodiment, which is represented in FIG. 6, the belt 6' with the standing edge 4 is provided on the outside of the curtain 2. The inner face is the face opposite the inner face which is directed towards the axis of curvature of the curtain when the latter has been rolled up.

The belt 1', which is situated on the side of the inner face of the curtain 2, has a base 20 with a certain thickness. The width of this base 20 corresponds substantially to the width of the belt 6' and the standing edge 4 as a whole. Thus, the base 20 of this belt 1' rests on the corresponding far end 15 of the sliding rail 13.

On the side of the outer face of the curtain 2 and on the other side of the slit 19, the standing edge 4 rests on the corresponding far end 15 of the section forming the sliding rail 13.

Consequently, said recess 10 in which the standing edge 4 is held while the curtain 2 is being rolled up, is situated above said base 20, laterally to the teeth 5 of the belt 1'.

FIGS. 7 to 12 represent yet another embodiment of the curtain according to the invention. In this embodiment, on each of the faces of the curtain near the two opposite lateral edges 3, are fixed serrated belts 1 and 6. When the curtain 2 is rolled up, the belts 1 and 6 of each of the lateral edges 3 will mesh.

The belt 1 is provided with a standing edge 4 formed of a succession of crosspieces 23 connecting the successive teeth 5 of said belt 1 in their median according to the longitudinal direction of the belts. The teeth 8 of the belt 6 provided on the opposite face of the curtain 2 have corresponding recesses 10 in which crosspieces 23 of the standing edge 4 are held while the curtain 2 is being rolled up. Thus, the belts 1 and 6 of each of the lateral edges 3 of the curtain 2 are fixed to each other and they cannot slide laterally in relation to one another when the curtain 2 is rolled up.

The drum 12, on which the curtain 2 is rolled up when the curtain 2 is moved into its open position, has a rib 24 over its circumference whose cross section corresponds to the section of the recess 10 provided in the teeth 8 of the serrated belt 6. Thus, when the curtain 2 is being rolled up so as to form a first winding, said rib 24 engages in the recess 10 of the teeth 8.

Figure 12:
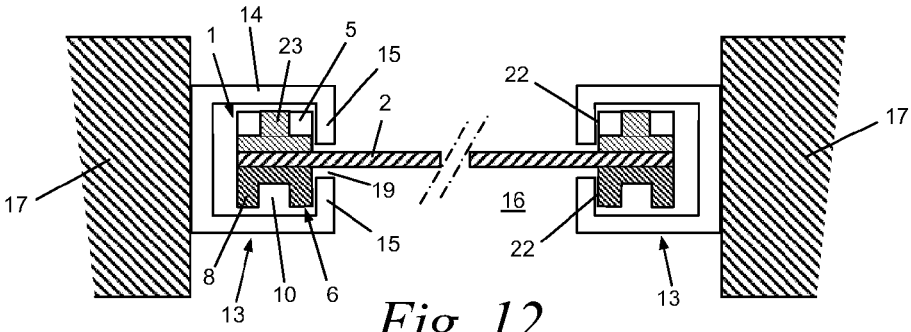
FIG. 12 is a cross section of the curtain from FIGS. 7 to 11 whose lateral edges are guided by sliding rails mounted in a bay.

The latter embodiment of the curtain according to the invention is advantageous in that the belts 1 and 6 can be rolled up in a very regular and stable manner, irrespective of the type of curtain being used. It is not necessary, for example, to stretch the curtain between its lateral edges so as to obtain a good winding of the lateral edges of the curtain. Moreover, the serrated belts and the lateral edges provided with these belts have a symmetrical plane which makes them easier to produce and to use. When the lateral edges 3 with the belts 1 and 6 are guided by sliding rails, as represented in FIG. 12, the contact surfaces between the belts 1 and 6 and the corresponding far end 15 of the sliding rail will be substantially identical on either side of the curtain 2 or on either side of the slit 19.

Figure 13:
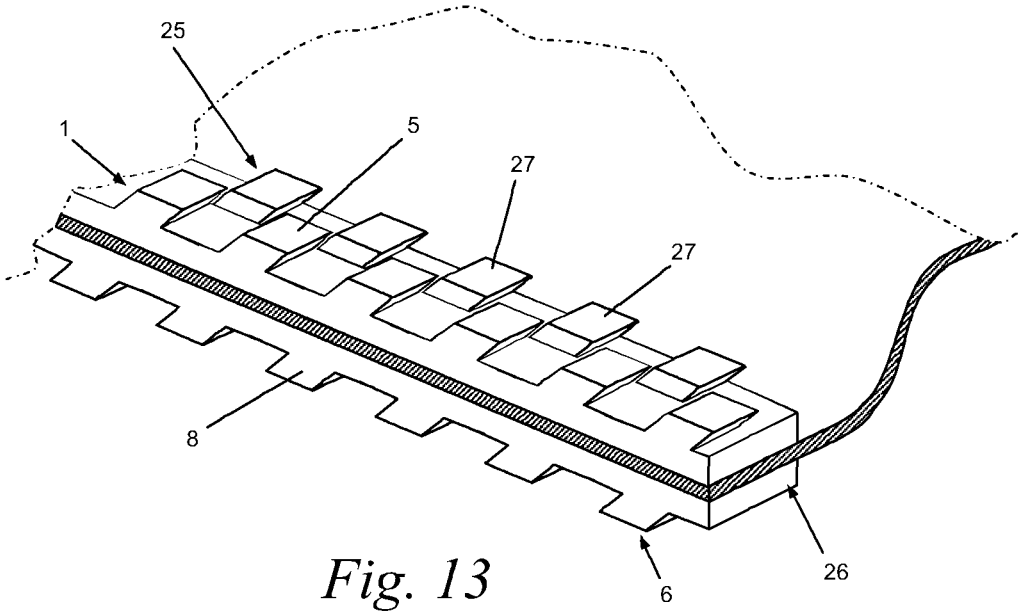
FIG. 13 is a view in perspective of a part of a curtain according to another embodiment of the invention.

FIG. 13 represents another embodiment of the device according to the invention which also offers the advantages of the preceding embodiments. In this embodiment, the curtain 2 has a serrated belt 1 and 6 on each of its opposite lateral edges on the opposite faces of the curtain 2, as already described above for the other embodiments of the invention. Adjacent to these belts 1 and 6 is provided a supporting element in the form of an additional serrated belt 25, 26 respectively, which also extends in the longitudinal direction of the lateral edges 3 on each of the faces of the curtain 2. These additional belts 25 and 26 of each lateral edge 3 mesh when the curtain 2 is being rolled up.

Moreover, the teeth 27 of the additional belts 25 and 26 are offset in relation to the teeth 5 and 8 of the above-mentioned corresponding belts 1 and 6, such that the teeth 5 and 8 of these belts 1 and 6 rest on the teeth 27 of the belts 25 and 26 when the curtain is rolled up. Thus, these additional belts 25 and 26 form a discontinuous standing edge 4.

It is clear that the present invention is not limited to the embodiments described above and represented in the accompanying drawings, but that also other variants are possible while still remaining within the scope of the present invention.

Thus, the standing edge may be situated on the side of the curtain opposite the one that is directed towards the centre of curvature of the rolled-up curtain. Further, a groove may separate the standing edge 4 from the teeth of the corresponding belt.

The shape of the teeth of the belts may strongly vary and it may for example have a rectangular or trapezoidal cross section or a cross section in the shape of clamps.

The standing edge 4 is preferably continuous, but it may also comprise a succession of aligned protrusions in the longitudinal direction of the lateral edges of the curtain.

The invention claimed is:

1. Device with a curtain (2) that can be rolled up and unrolled between a shut position and an open position, wherein the curtain (2) has lateral edges (3) and opposing faces and comprising, near the lateral edges (3) on each opposing face, a serrated belt (1,6) extending parallel to said lateral edges (3), wherein each of the serrated belts (1,6) has successive teeth (5,8) along a longitudinal direction of the lateral edges (3), and a lateral face of each of the teeth is extending in the longitudinal direction of the lateral edges (3), wherein said lateral face of the teeth of at least one of the belts (1,6) provided on a first of said opposing faces of the curtain (2) bears against a supporting element when the curtain (2) is rolled up, wherein said supporting element is provided on a second of said opposing faces of the curtain (2) and wherein the curtain extends along a plane in the open position, wherein the successive teeth of each of the belts interlock along the longitudinal direction of the lateral edges when the curtain is rolled up, the lateral face of the teeth is perpendicular to the plane of the curtain, and wherein the supporting element directly extends from one of the serrated belts.

2. Device with a curtain (2) according to claim 1, wherein the supporting element comprises a standing edge (4) extending near each of the lateral edges (3) of the curtain (2) over at least a face of the curtain and parallel to said lateral edges (3), such that when the curtain (2) is rolled up, the standing edge (4) will bear against the belt (1,6) provided on the opposite face of the curtain (2).

3. Device according to claim 2, wherein, near to the face of the curtain opposite the face on which the standing edge (4) is provided, the curtain has a corresponding recess (10) in which said standing edge (4) can engage when the curtain (2) is being rolled up.

4. Device according to claim 3, wherein the curtain has a centre of curvature when the curtain is rolled-up, wherein the standing edge (4) extends along a side of the face of the rolled-up curtain (2), wherein the face of the rolled-up curtain (2) faces towards the centre of curvature of the curtain when the curtain is rolled-up, and the recess (10) is situated near the lateral edge (3) of the curtain on a side of the curtain (2) opposite the side with the standing edges (4).

5. Device according to claim 3, wherein the standing edge (4) is situated on the side of the curtain (2) opposite the one which is directed towards the centre of curvature of the rolled-up curtain (2).

6. Device according to any one of claims 2 and 3, wherein the teeth (5) of a first belt of said serrated belts (1) have a top face, wherein the standing edge (4) is provided on a same face of said curtain as this first belt and extends substantially up to the top face of the teeth (5) of said first serrated belt (1).

7. Device according to any one of claims 2 and 3, wherein the standing edge (4) is provided on the lateral side of the teeth (5) opposite the side of the teeth that is directed towards the corresponding lateral edge of the curtain (2).

8. Device according to claim 3, wherein the standing edge (4) is provided on a first serrated belt (1) of said serrated belts, whereas the recess (10) is situated on the side of the curtain (2) opposite the side of the curtain where said first belt (1) is situated and adjacent to the teeth (8) of a second belt of said serrated belts provided on the opposite side.

9. Device according to any one of claims 1 to 3, wherein the supporting element comprises a serrated belt which is adjacent to the above-mentioned belts (1,6) and which extends in the longitudinal direction of the lateral edges (3) on each face of the curtain (2), wherein the belts form corresponding supporting elements provided near the same lateral edge (3), such that they mesh when the curtain (2) is being rolled up.

10. Device according to any one of claims 1 to 3, wherein the supporting element comprises a serrated belt which is adjacent to at least one of the above-mentioned belts (1,6) and which has teeth that are offset in relation to the teeth (5,8) of the above-mentioned belt (1,6).

11. Device according to any one of claims 1 and 2, further comprising at least one sliding rail (13) to guide at least one lateral edge of the curtain (2) provided with the corresponding belts (1,6).

12. Device according to claim 11, wherein said sliding rail (13) comprises a section with a U-shaped or C-shaped cross section with wings (14) whose far ends (15) are folded towards each other, such that the lateral edge (3) is kept in place, and so as to allow the passage of the curtain (2) through a slit (19) provided between said far ends (15), in which the belts (1,6) and the supporting element are situated inside the sliding rail (13) and rest on said far ends (15) of the latter.

13. Device according to claim 11, wherein said sliding rail (13) comprises a section with a U-shaped or C-shaped cross section with wings (14) whose far ends (15) are folded towards each other, such that the lateral edge (3) is kept in place, and so as to allow the passage of the curtain (2) through a slit (19) provided between said far ends (15), in which the supporting element is situated inside the sliding rail (13) and rests on said far ends (15) of the latter.

14. Device according to claim 11, wherein said sliding rail (13) comprises a section with a U-shaped or C-shaped cross section with wings (14) whose far ends (15) are folded towards each other, such that the lateral edge (3) is kept in place, and so as to allow the passage of the curtain (2) through a slit (19) provided between said far ends (15), in which the belts (1,6) are situated inside the sliding rail (13) and rest on said far ends (15) of the latter.

* * * * *